US006766236B1

(12) United States Patent
Lamela et al.

(10) Patent No.: US 6,766,236 B1
(45) Date of Patent: Jul. 20, 2004

(54) SKID STEER DRIVE CONTROL SYSTEM

(75) Inventors: Anthony J. Lamela, Gilberts, IL (US); Brian E. Felsing, Park Ridge, IL (US); Peter J. Dix, Naperville, IL (US); John R. Harms, Wichita, KS (US); Hong-Chin Lin, Portland, OR (US); Troy D. Bateman, Plainfield, IL (US)

(73) Assignee: Case, LLC, Racine, WI (US)

( * ) Notice: Subject to any disclaimer, the term of this patent is extended or adjusted under 35 U.S.C. 154(b) by 0 days.

(21) Appl. No.: 10/609,219

(22) Filed: Jun. 27, 2003

(51) Int. Cl.[7] ..... C06G 7/78

(52) U.S. Cl. ..... 701/50; 701/70; 180/6.3; 180/6.48

(58) Field of Search ..... 701/1, 36, 41, 701/49, 50, 70; 180/6.2, 6.3, 6.48; 280/6.15; 172/811

(56) References Cited

U.S. PATENT DOCUMENTS 6,167,980 B1 * 1/2001 Anderson et al. ..... 180/311
6,171,050 B1 * 1/2001 Johnson ..... 414/685
6,283,220 B1 * 9/2001 Carter ..... 169/24
6,650,985 B2 * 11/2003 Lin et al. ..... 701/50
6,663,114 B2 * 12/2003 Lamela et al. ..... 280/6.15

* cited by examiner

*Primary Examiner*—Richard M. Camby
(74) *Attorney, Agent, or Firm*—John William Stader; Collin A. Webb

(57) ABSTRACT

A control system for a skid steer vehicle reads a load height sensor, a load amount sensor, and a vehicle speed sensor to derate the otherwise commanded acceleration, deceleration and turning rate on the vehicle when the vehicle has too great a load, too high a load, or the vehicle is going too fast.

16 Claims, 3 Drawing Sheets

SKID STEER DRIVE CONTROL SYSTEM

RELATED APPLICATIONS

This application is related to U.S. patent application Ser. No. 10/034,421, filed Dec. 28, 2001, which is incorporated herein by reference for all that it teaches.

FIELD OF THE INVENTION

The invention relates to electronic control systems of work vehicles. More particularly, it relates to electronically controlled drive systems for skid steer loaders.

BACKGROUND OF THE INVENTION

Skid steer vehicles such as skid steer loaders are a mainstay of construction work. In their common configuration, they have two or three drive wheels on each side of a chassis that are driven in rotation by one or more hydraulic motors coupled to the wheels on one side and another one or more hydraulic motors coupled to the wheels on the other side.

The wheels on one side of the vehicle can be driven independently of the wheels on the other side of the vehicle, thus permitting the wheels to be rotate in opposite directions on opposing sides of the vehicle, thereby causing the skid steer vehicle to spin in place about a vertical axis that extends upward through the vehicle itself.

The vehicles have an overall size of about 10 by 12 feet, which, when combined with their ability to rotate in place, gives them considerable mobility at a worksite. It is this mobility that makes them a favorite.

Skid steer vehicles commonly have a loader or lift arm that is pivotally coupled to the chassis of the vehicle to raise and lower at the operator's command. This arm typically has a bucket, blade or other implement attached to the end of the arm that is lifted and lowered thereby. Perhaps most commonly, a bucket is attached, and the skid steer vehicle is used to carry supplies or particulate matter such as gravel, sand, or dirt around the worksite.

One of the disadvantages of traditional skid steer vehicles is their lack of a sprung suspension. The wheels that support the skid steer vehicle chassis are typically fixed with respect to the chassis. They do not move up or down with respect to the chassis, and hence the only shock-absorbing capability they provide is due to the compressions of the wheels. If solid wheels are used, however, they do not even have the compression to absorb impact and cushion travel over irregular terrain.

As a result, skid steer vehicles have been constrained to move at relatively low speeds, seldom above 6 miles per hour, when moving over the irregular terrain of a construction site. Speeds much above this level would permit the vehicle to pitch and roll to a significant degree, which might dump some of the load out of the bucket.

Another reason unsprung skid steer vehicles are limited to low speeds is to give the operator a smoother ride. When skid steer vehicles are operated at speed much over 6 mph, the chassis bounces and rolls so much that the operator experiences a rough and unpleasant ride.

In the last few years, however, manufacturers of skid steer vehicles have begun to add suspensions to their skid steer vehicles. These suspensions permit the skid steer vehicle wheels to move up and down with respect to the chassis. This configuration permits the skid steer vehicles to operate at higher ground speed than the common 6 mph, yet absorbs the ground impacts and terrain irregularities that might otherwise cause significant vehicle bouncing, bucket emptying and operator injury.

Sprung suspensions do have some untoward effects on skid steer vehicle handling under certain operational conditions, however. Skid steer vehicles have a relatively compact wheelbase. They are loaded by filling a bucket and raising the bucket in the air above the operator's head. The loaded bucket is not disposed at the center of the vehicle, its weight evenly distributed overall four wheels, but is typically cantilevered outward away from the vehicle at the front wheels. In addition to this, a sprung skid steer vehicle can roll and pitch to a much greater degree than an unsprung skid steer vehicle and can also travel at greater speeds over ground, including the irregular terrain of a work site. All of these factors combined could make a sprung skid steer vehicle handle poorly, especially if it carries heavy loads lifted high in the air, and travels at high (+6 mph) speeds over rough terrain, Other arrangements have been proposed to resist the pitching and rolling of a sprung skid steer vehicle, for example, by restricting the free motion of the vehicle suspension in a variety of ways. While this is beneficial, it does require additional devices that increase the cost and complexity of the vehicle.

What is needed, therefore, is a different system of reducing the pitching and rolling of a skid steer vehicle that limits the vehicle's turn rate. It is an object of this invention to provide such a system.

SUMMERY OF THE INVENTION

In accordance with a first embodiment of the invention, a control system for the drive and steering of a skid steer vehicle having a loader arm capable of carrying a load, the control system is provided, including (i) a means for sensing the amount of load and generating a signal indicative thereof; (ii) a means for sensing the height of the load and generating a signal indicative thereof; (iii) a means for sensing the speed of the vehicle and generating a signal indicative thereof; (iv) a means responsive to operator manipulation for generating an operator vehicle motion command; and (v) an electronic controller coupled to the means of (i), (ii), (iii), and (iv) above, to receive the signals and command therefrom and to generate a drive signal based upon the signals received from the means of paragraphs (i), (ii), (iii), and (iv). The drive signal may control the displacement of at least one positive displacement hydraulic pump. The drive signal may control the displacement of at least two positive displacement pumps. The two positive displacement pumps may include a first positive displacement pump that is fluidly coupled to at least a first hydraulic motor rotationally coupled to and disposed to drive at least one vehicle wheel on the left side of the vehicle and at least a second hydraulic motor rotationally coupled to and disposed to drive at least a second vehicle wheel disposed on the right side of the vehicle. The means for sensing the amount of load may include a pressure sensor capable of measuring the pressure of a tire, the pressure of a loader cylinder, or the pressure of a suspension cylinder. The means for sensing the height of the loader arm may include a loader cylinder position sensor or a loader arm position sensor. The means for sensing the vehicle speed may include a wheel speed sensor, a hydrostatic motor speed sensor, a GPS receiver, a ground sensing laser, or a ground-sensing radar. The means responsive to operator manipulation may include a joystick or a left-hand drive lever and right-hand drive lever. The load sensor may include a sensor disposed to detect the pressure in a loader arm lift cylinder.

In accordance with a second embodiment of the invention, a method of controlling the steering of a skid steer vehicle having a plurality of wheels mounted on the left vehicle side driven by at least a first hydraulic motor and a plurality of wheels on the right vehicle side driven by at least a second hydraulic motor, the vehicle further including at least a first hydraulic pump to drive the at least a first hydraulic motor and at least a second hydraulic pump to drive the at least a second hydraulic motor and an electronic controller coupled to the at least a first and at least a second hydraulic pumps to control their specific displacement is provided, the method including the steps of (i) receiving a signal representative of a vehicle load; (ii) receiving a signal representative of the height of at least a portion of the vehicle load; (iii )receiving a signal representative of the speed of the vehicle; (iv) receiving an operator-generated vehicle motion command; and (v) combining the signals of steps (i), (ii), and (iii), with the command of step (iv) to generate a drive signal. The vehicle further may include at least one loader having a first end and a second end, an implement coupled to the first end and a vehicle chassis coupled to the second end, and further wherein at least a portion of the vehicle load includes a load carried by the implement. The method may include the step of applying the drive signal to a positive displacement hydraulic pump to control the displacement thereof. The step of combining the signals may include the step of derating the vehicle's response to the operator-generated vehicle motion command. The step of derating the vehicle's response may include the step of derating the vehicle's turning rate. The step of derating the vehicle's response may include the step of derating the vehicle's rate of acceleration. The step of derating the vehicle's response may include the step of derating the vehicle's rate of deceleration.

DETAILED DESCRIPTION OF THE PREFERRED EMBODIMENTS

The discussion below describes the configuration of a skid steer loader having a differential drive system in which the wheels on each side of the vehicle can be driven independently to each other. The loader has an electronic control system capable of electronically monitoring the skid steer loader's load, the height of that load, the speed the vehicle is going, and of responsively derating or reducing the drive system's response to operator commands. The electronic control system combines these sensor signals and, based on predetermined rules stored in the electronic control system, determines whether to and how much to derate the drive system.

Figure 1:
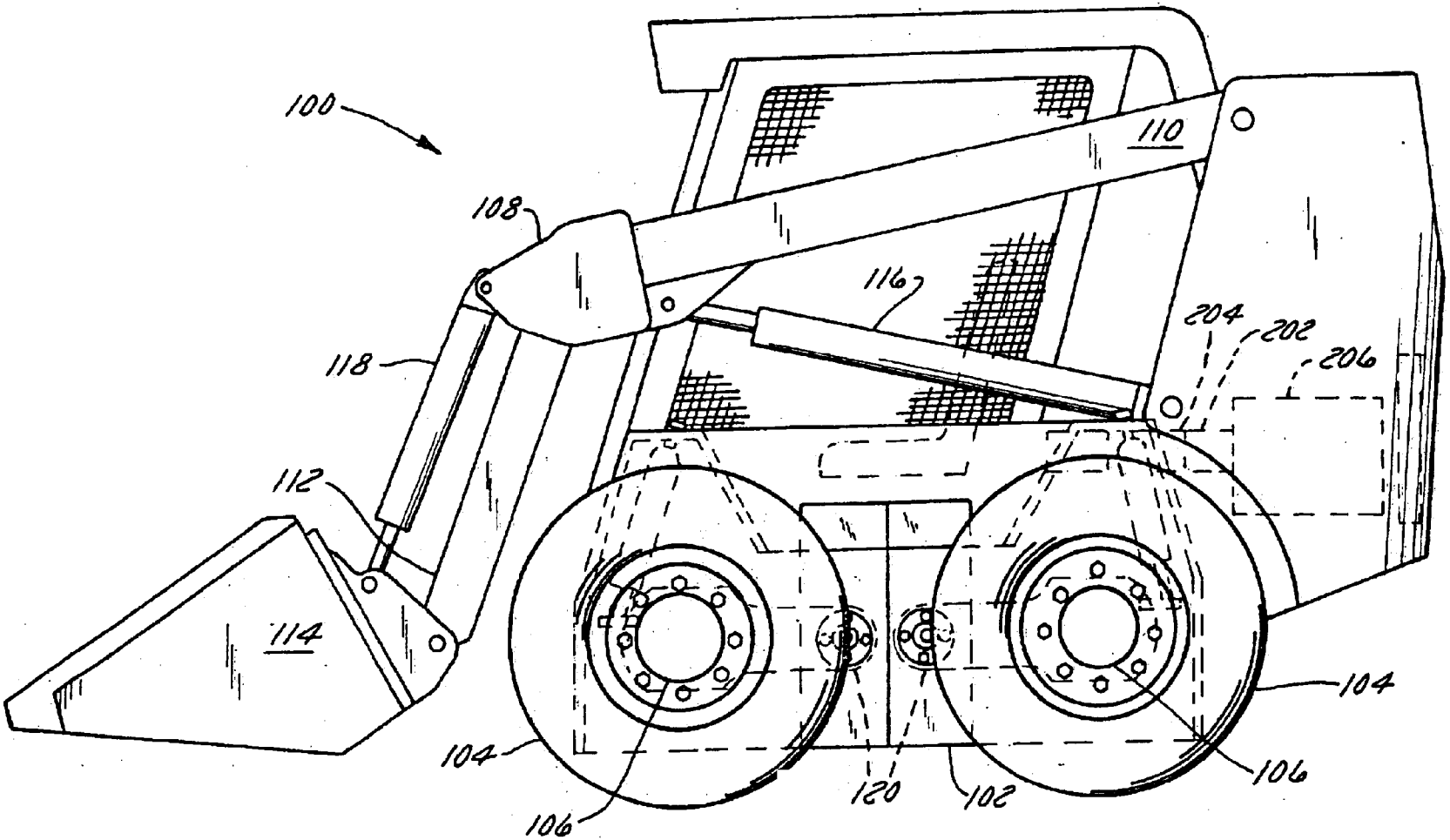
FIG. 1 is a side view of a skid steer vehicle in accordance with the present invention, showing the chassis, wheels, loader arm and bucket as well as the hydraulic actuators that move the bucket and the loader arms.
Figure 2:
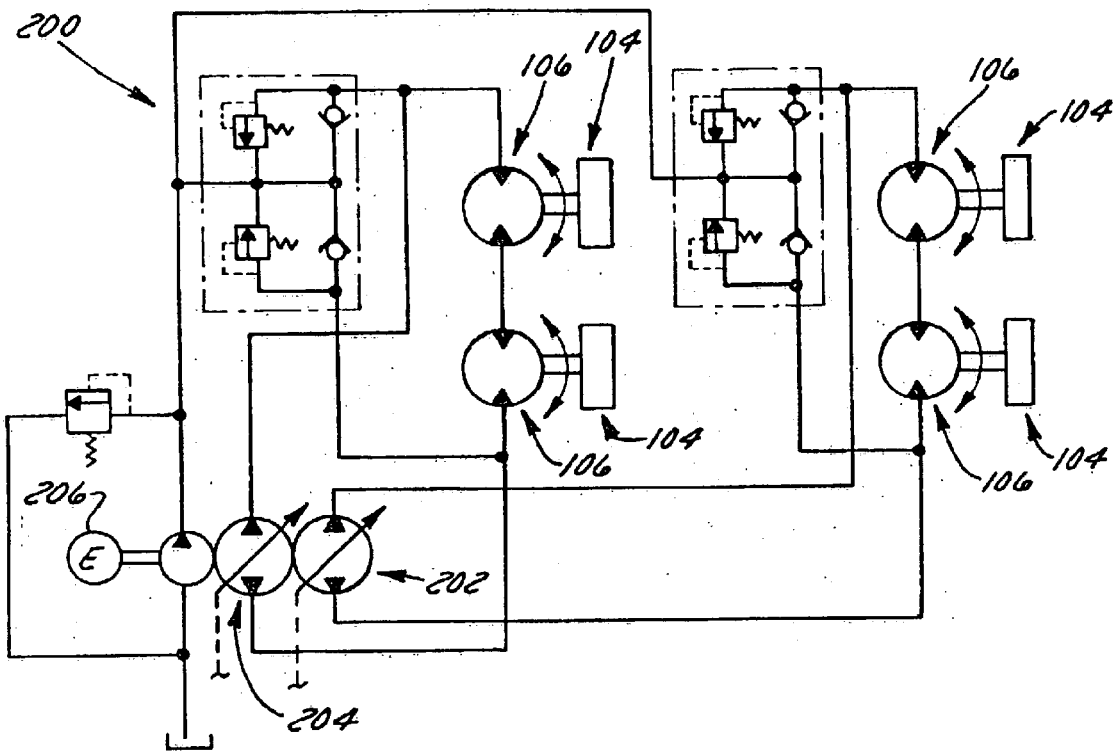
FIG. 2 is a hydraulic schematic diagram of the hydraulic drive system of the skid steer vehicle of FIG. 1, showing the two hydraulic pumps that drive four hydraulic motors that in turn are coupled to and drive the vehicle's four wheels.
Figure 3:
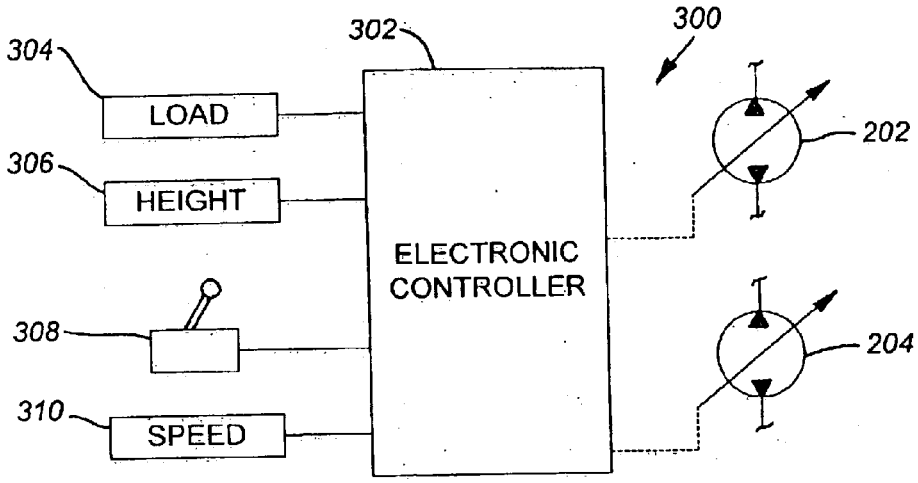
FIG. 3 is a schematic diagram of an electronic control system including several sensors to indicate vehicle speed, bucket load and bucket (or loader arm) height, an operator input device to generate a command signal of a desired speed and direction of motion, and at least one electronic controller to monitor the sensor and input device signals and responsively control the displacement of the hydraulic drive pumps to control the vehicle speed and steering.

FIG. 1 illustrates the vehicle overall showing its major mechanical and hydraulic components. FIG. 2 illustrates the hydraulic circuit, including the motors driving the wheels and the pumps coupled to the vehicle's engine that supply fluid to the motors. The motors, in turn are connected to the wheels shown in FIG. 1 to drive them and hence drive the vehicle over the ground. FIG. 3 illustrates the vehicle's electronic control system, the sensors that gather data, the operator input device that the operator uses to control the direction and speed of the vehicle and the drivers that, in turn send a drive signal to the variable displacement hydraulic pumps that drive the vehicle hydraulic motors and hence its wheels. The electronics control system is programmed to read the sensors and calculate the drive signal applied to the variable displacement hydraulic pumps in a special manner that derates, reduces or attenuates the drive signal under certain circumstances when the load is too great, the load is too high in the air and the vehicle is traveling too fast TABLE 1 is a display of the circumstances under which the electronic controller derates or reduces its response when the vehicle is traveling too fast, the load on the bucket is too great or the bucket is too high.

Referring now to FIG. 1, a skid steer vehicle 100 is illustrated having a chassis 102 to which four wheels 104 are coupled in fore-and-aft relation, two wheels on each side of the vehicle, each wheel being coupled to and driven by a corresponding hydraulic drive motor 106.

A mechanical linkage is here exemplified as two loader arms or lift arms 108 which are pivotally coupled to the chassis 102 of the vehicle 100 at one end 110 of the arms. The other end 112 of the arms is pivotally connected to an implement (herein shown as a bucket 114 that performs useful work. In the side view of FIG. 1, only one arm 108 can be seen. The other arm 108 is mounted on the other side of the vehicle in the same position as the arm shown in FIG. 1.

Two actuators, here exemplified as hydraulic lift cylinders 116 are coupled to and between the arms 108 and the chassis 102 of the vehicle to lift the arms 108 with respect to the chassis 102. Two additional actuators, here shown as a pair of hydraulic bucket cylinders 118 are similarly coupled to and between the bucket 114 and the loader arms 108 to pivot the bucket with respect to the loader arms.

Each wheel and associated hydraulic motor is supported at a free end of a control arm 120. There are four control arms 120, each pivotally coupled to the bottom of the chassis 102. Two forward control arms 120 (one shown here) extend forward on either side of the chassis 102 and support the front two wheels. Two rear control arms 120 (one shown here) extend backward on either side of the chassis 102 and support the two rear wheels. These four control arms are sprung and suspend the wheels. Details of the control arms and the suspension, generally, can be found in co-pending U.S. patent application Ser. No. 10,034,421 ("the '421 Application"), filed Dec. 28, 2001, which is incorporated herein by reference for all that it teaches.

While the actuators shown here are hydraulic cylinders, they may be electric, hydraulic or pneumatic actuators. The mechanical linkage shown here as a pair of loader arms may be one or more loader arms in any combination of bars or mechanical links that is configured to lift or lower the implement. The implement, shown here as bucket 114 need not be a bucket, but may be any implement coupled to the end of the mechanical linkage to perform work.

In FIG. 1 the vehicle is supported on four wheels, each of which is driven by a corresponding individual hydraulic motor. While this arrangement is preferred, other arrangements are also considered satisfactory, such as two motors, one for each side of the vehicle that are coupled to one or more wheels on each side of the vehicle. There may be six or eight wheels. The wheels may be pneumatic or solid. They may be metal, rubber or plastic. Some or all may be driven. A track may extend around the wheels to form a tracked drive.

The illustrated motors are preferably hydraulic. In the alternative, they may be electrical or pneumatic. The motors are directly coupled to the wheels they drive. They may also be indirectly coupled through shaft, gear, belt, chain and gearbox arrangements that extend between the motor and the wheel or wheels to which the motor is coupled.

FIG. 2 illustrates a preferred vehicle drive system 200 for the skid steer loader 100. The drive system 200 includes the four wheels 104 rotationally coupled to the four corresponding hydraulic-motors 106. The two motors on the left side of the vehicle are coupled together in series with a variable displacement hydraulic pump 202. The two motors on the right side of the vehicle are coupled together in series with a variable displacement hydraulic pump 204. Pumps 202 and 204 can drive motors 106 both forward and backward, depending on the direction of fluid flow through the pumps.

The two hydraulic pumps 202 and 204 are coupled to internal combustion engine 206 of the vehicle which drives the pumps in rotation. The speed and direction of the wheels' rotation can be changed by varying the displacement of pumps 202 and 204. The pumps include integral electronic drive circuitry responsive to pump drive signals provided on signal lines 208 and 210, respectively, that change the displacement and direction of flow of fluid through the pumps under electronic control. Details of a preferred hydraulic drive system can be found in the '421 Application.

When both the pumps have the same displacement and fluid flow is in a forward direction, the motors on both-sides of the vehicle are driven at the same speed and the vehicle travels straight forward since they are driven at the same speed by engine 206. When both the pumps have the same displacement and fluid flow is in a reverse direction, the motors on both sides of the vehicle are driven at the same speed and the vehicle travels straight backward.

When the displacement of the motors is different, but flow is in the same direction (either forward or reverse) the wheels on each side turn at different speeds, skid somewhat, and the vehicle turns toward the side with the slower moving wheels.

When the displacement of the wheels is generally the same and the direction of flow is forward through the motors on one side and reverse through the motors on the other side, the wheels on opposite sides of the vehicle turn in opposite direction, skid significantly, and the vehicle rotates about an axis that extends through the middle of the vehicle.

The vehicle's electronic control system provides all these modes of travel in response to the operator's manipulation of an operator input device, such as a joystick, by which the operator indicates his desired direction and speed of travel. FIG. 3 illustrates the electronic control system in more detail.

The electronic control system 300 includes an electronic controller 302 which is comprised of one or more individual microcontrollers or microprocessors that are networked over a serial communication bus such as a CAN bus (not shown). Details of a preferred multiprocessor arrangement of the electronic control system for a skid steer vehicle can be found in the '421 Application.

There are several sensors connected to the electronic controller 302 that provide the electronic controller with data indicating both vehicle load and the relative height of the load with respect to the chassis 102 of the vehicle.

The first of these sensors is load sensor 304. In the preferred embodiment, this sensor is a pressure sensor in fluid communication with the loader lift cylinder to generate a signal indicative of fluid pressure in the cylinder. As the load increases in the bucket, the hydraulic fluid pressure required to lift the bucket increases. The pressure in the hydraulic lift cylinders therefore indicates at least in part the load placed in the bucket. The particular relationship of pressure to bucket load depends of course upon the particular configuration and arrangement of the loader lift arms supporting the bucket. In an alternative embodiment, the load sensor can be a pressure sensor coupled to a suspension cylinder. See, for example, the suspension cylinders of the '421 Application. The load sensor can alternatively be a pressure sensor coupled to a pneumatic tire of the skid steer loader to sense tire pressure.

The second of these sensors is a position or height sensor 306. In the preferred embodiment it is a sensor coupled to one of the lift cylinders to generate a signal indicative of lift cylinder extension. It may include a rotary position sensor or a linear position sensor coupled to the moveable structure of the lift arms or any other portion of the linkage. It may include a non-contact sensor such as a proximity sensor that generates a relative position signal that is based on capacitance or inductance. It may include a radiation sensor such as an ultrasonic, radar, or laser sensor that measures distance. It may include a flow sensor indicating fluid flow into or out of a hydraulic cylinder or other actuator that is related to the actuator position, such as a flow sensor coupled to the lift cylinder. Or it may include a sensor responsive to remote signals correlated to height, such as such as a GPS or barometric pressure sensor.

Electronic controller 302 is also coupled to an operator input device 308 that is manipulable by the operator to signal a desired direction and speed of travel. Device 308 is preferably a joystick. The joystick generates two signals, a first signal indicating the deflection of the joystick along a fore-and-aft axis parallel to the fore-and-aft axis of the skid steer vehicle, and a second signal indicating the deflection along an orthogonal side-to-side axis parallel to the side-to-side axis of the skid steer vehicle.

Generally speaking, the operator indicates his desire to go straight forward or straight backward by moving the joystick straight forward or straight backward, respectively, with no deflection of the lever in a side-to-side direction. The operator indicates his desire to turn to the left or the right by moving the joystick side-to-side along the lateral axis of the joystick (i.e. to the right or to the left).

Electronic controller 302 is also coupled to a speed sensor 310 that generates a signal indicating the fore-and-aft velocity of the skid steer loader. Speed sensors may be wheel speed sensors disposed to sense the speed of wheels 104, hydrostatic motor speed sensors disposed to sense the speed of motors 106, GPS receivers, lasers, or ground-sensing radars on the vehicle and disposed to sense the speed of the ground with respect to vehicle 100.

The electronic control system 300 is therefore configured to receive signals indicating the speed of the skid steer loader, the height of the load above the skid steer loader, the amount of load on the skid steer loader, and the direction and speed of travel desired by the operator.

In one common arrangement, the left-hand and right hand levers include rotary sensors that generate a signal proportional to the degree of rotation of the levers. When the operator pushes the left lever forward, a signal indicating that degree of rotation is sent to controller 302. Controller 302, in turn, generates a pump drive signal proportional to the degree of deflection and applies it to associated drive pump 202. The drive pump responsively increases its displacement. Controller 302 scales the signal from the lever such that the speed of rotation of the wheels is proportional to the degree of deflection of the lever. This is the basic or standard drive pump signal that controller 302 further attenuates in response to the height or magnitude of the load and the vehicle speed.

While the paragraph above describes a typical method of generating a pump signal in response to lever or joystick movement, it is by no means the only possible method. What is significant about the present device is that it attenuates this basic or standard signal in response to certain changing conditions and not the way the basic or standard drive signal is calculated.

The standard pump drive signal calculated above is reduced or derated under certain operating conditions. If the vehicle is going forward or backward at too high a speed, if the load on the vehicle (e.g. the bucket load) is too great, and if the vehicle load (the bucket load) is too high in the air, the electronic controller is configured to reduce or derate the standard drive signal by a predetermined amount. By reducing the drive signal, the speed at which the vehicle travels, how fast it turns, and how fast it accelerates or decelerates is reduced.

Electronic controller 302 combines the speed, load and load height signals in accordance with a set of predetermined rules to reduce or derate the drive signal. The rules by which electronic controller 302 calculates the reduction in the drive signal may be internally expressed in equation form, as lookup tables or as a combination of the two, for example.

These rules and the amount they reduce the drive signal are illustrated in TABLE 1, in which the first column identifies the rule number, the second column indicates the condition or test that controller 302 tests for, and columns 3–8 indicate the control action taken by controller 302 if the condition or conditions of column 2 are met.

In TABLE 1, the third column indicates the percentage reduction in the rate of steering (both to the left and to the right). The fourth column indicates the reduction in forward acceleration. The fifth column indicates the reduction in backward acceleration (also known as deceleration, negative acceleration, or the rate of slowing down). The sixth column indicates whether the controller locks out FNR operation. By locking out FNR operation, the system prevents the vehicle from immediately reversing direction of movement when the vehicle is moving forward and the operator rapidly moves the manual position and speed controls from a position indicating forward motion to a position indicating reverse motion, and when the vehicle is moving in reverse and the operator rapidly moves the manual position and speed controls from a position indicating reverse motion to a position indicating forward motion.

The seventh column indicates whether controller 302 locks out vehicle counter-rotation, and the eighth column indicates whether controller 302 limits the vehicle to a maximum speed.

The term "Ground Speed" in TABLE 1 below refers to the speed of the vehicle measured by the speed sensor. The term "Bucket Load" refers to the load on the bucket measured by the load sensor. The term "Bucket Height" refers to the height of the bucket as measured by the height sensor. The term "Joystick Position" refers to the position of the operator input device as a percentage of its full range of travel.

TABLE 1

| | | THEN: | | | | | |
|---|---|---|---|---|---|---|---|
| | IF: (conditions:) | Steering Gain (%) | Accel. (%) | Decel. (%) | FNR Locked Out | Ctr-rot. Locked Out | Max Speed (MPH) |
| 1 | Ground Speed = 0–3 MPH | 100 | 100 | 100 | N | N | N |
| 2 | Ground Speed = 3–6 MPH | 100 | 100 | 100 | N | N | N |
| 3 | Ground Speed = 6–12 MPH | 75 | 85 | 85 | Y | Y | N |
| 4 | Ground Speed > 12 MPH | 50 | 75 | 75 | Y | Y | N |
| 5 | Bucket Load = 0–600 lb | 100 | 100 | 100 | N | N | N |
| 6 | Bucket Load = 600–1200 lb | 100 | 75 | 75 | N | N | N |
| 7 | Bucket Load > 1200 lb | 100 | 50 | 70 | N | N | N |
| 8 | Bucket Height = 0–2.5 ft | 100 | 100 | 100 | N | N | N |
| 9 | Bucket Height = 2.5–5 ft | 100 | 75 | 75 | N | N | N |
| 10 | Bucket Height > 5 ft | 90 | 50 | 50 | N | N | 6 |
| 11 | Joystick Position < 50% travel | 100 | 100 | 100 | N | N | N |
| 12 | Joystick Position > 50% travel | 100 | 100 | 100 | Y | Y | N |
| 13 | Ground Speed = 0–3 MPH AND Bucket Load = 0–600 lb | 100 | 100 | 100 | N | N | N |
| 14 | Ground Speed = 0–3 MPH AND Bucket Load = 600–1200 lb | 100 | 75 | 75 | N | N | N |
| 15 | Ground Speed = 0–3 MPH AND Bucket Load > 1200 lb | 100 | 50 | 70 | N | N | N |
| 16 | Ground Speed = 3–6 MPH AND Bucket Load = 0–600 lb | 100 | 100 | 100 | N | N | N |
| 17 | Ground Speed = 3–6 MPH AND Bucket Load = 600–1200 lb | 100 | 75 | 75 | N | N | N |
| 18 | Ground Speed = 3–6 MPH AND Bucket Load > 1200 lb | 100 | 50 | 70 | N | N | N |

TABLE 1-continued

| | IF: (conditions:) | THEN: Steering Gain (%) | Accel. (%) | Decel. (%) | FNR Locked Out | Ctr-rot. Locked Out | Max Speed (MPH) |
|---|---|---|---|---|---|---|---|
| 19 | Ground Speed = 6–12 MPH AND Bucket Load = 0–600 lb | 75 | 85 | 85 | Y | Y | N |
| 20 | Ground Speed = 6–12 MPH AND Bucket Load = 600–1200 lb | 75 | 85 | 85 | Y | Y | N |
| 21 | Ground Speed = 6–12 MPH AND Bucket Load > 1200 lb | 75 | 50 | 70 | Y | Y | N |
| 22 | Ground Speed > 12 MPH AND Bucket Load = 0–600 lb | 50 | 75 | 75 | Y | Y | N |
| 23 | Ground Speed > 12 MPH AND Bucket Load = 600–1200 lb | 50 | 75 | 75 | Y | Y | N |
| 24 | Ground Speed > 12 MPH AND Bucket Load > 1200 lb | 50 | 50 | 70 | Y | Y | N |
| 25 | Ground Speed = 0–3 MPH AND Bucket Height = 0–2.5 ft | 100 | 100 | 100 | N | N | N |
| 26 | Ground Speed = 0–3 MPH AND Bucket Height = 2.5–5 ft | 100 | 75 | 75 | N | N | N |
| 27 | Ground Speed = 0–3 MPH AND Bucket Height > 5 ft | 90 | 50 | 70 | N | N | N |
| 28 | Ground Speed = 3–6 MPH AND Bucket Height = 0–2.5 ft | 100 | 100 | 100 | N | N | N |
| 29 | Ground Speed = 3–6 MPH AND Bucket Height = 2.5–5 ft | 100 | 75 | 75 | N | N | N |
| 30 | Ground Speed = 3–6 MPH AND Bucket Height > 5 ft | 90 | 50 | 70 | Y | Y | N |
| 31 | Ground Speed = 6–12 MPH AND Bucket Height = 0–2.5 ft | 75 | 85 | 85 | Y | Y | N |
| 32 | Ground Speed = 6–12 MPH AND Bucket Height = 2.5–5 ft | 75 | 75 | 75 | Y | Y | N |
| 33 | Ground Speed = 6–12 MPH AND Bucket Height > 5 ft | 75 | 50 | 70 | Y | Y | 6 |
| 34 | Ground Speed > 12 MPH AND Bucket Height = 0–2.5 ft | 50 | 75 | 75 | Y | Y | N |
| 35 | Ground Speed > 12 MPH AND Bucket Height = 2.5–5 ft | 50 | 75 | 75 | Y | Y | N |
| 36 | Ground Speed > 12 MPH AND Bucket Height > 5 ft | 50 | 50 | 70 | Y | Y | 6 |
| 37 | Ground Speed = 0–3 MPH AND Bucket Load = 0–600 lb AND Bucket Height = 0–2.5 ft | 100 | 100 | 100 | N | N | N |
| 38 | Ground Speed = 0–3 MPH AND Bucket Load = 600–1200 lb AND Bucket Height = 0–2.5 ft | 100 | 75 | 75 | N | N | N |
| 39 | Ground Speed = 0–3 MPH AND Bucket Load > 1200 lb AND Bucket Height = 0–2.5 ft | 100 | 50 | 70 | N | N | N |
| 40 | Ground Speed = 0–3 MPH AND Bucket Load = 0–600 lb AND Bucket Height = 2.5–5 ft | 100 | 75 | 75 | N | N | N |
| 41 | Ground Speed = 0–3 MPH AND Bucket Load = 0–600 lb AND Bucket Height > 5 ft | 90 | 50 | 70 | N | N | N |
| 42 | Ground Speed = 0–3 MPH AND Bucket Load = 600–1200 lb AND Bucket Height = 2.5–5 ft | 100 | 75 | 75 | N | N | N |
| 43 | Ground Speed = 0–3 MPH AND Bucket Load = 600–1200 lb AND Bucket Height > 5 ft | 90 | 50 | 70 | N | N | N |
| 44 | Ground Speed = 0–3 MPH AND Bucket Load > 1200 lb AND Bucket Height = 2.5–5 ft | 100 | 50 | 70 | N | N | N |
| 45 | Ground Speed = 0–3 MPH AND Bucket Load > 1200 lb AND Bucket Height > 5 ft | 90 | 50 | 70 | N | N | N |
| 46 | Ground Speed = 3–6 MPH AND Bucket Load = 0–600 lb AND Bucket Height = 0–2.5 ft | 100 | 100 | 100 | N | N | N |
| 47 | Ground Speed = 3–6 MPH AND Bucket Load = 600–1200 lb AND Bucket Height = 0–2.5 ft | 100 | 75 | 75 | N | N | N |
| 48 | Ground Speed = 3–6 MPH AND Bucket Load > 1200 lb AND Bucket Height = 0–2.5 ft | 100 | 50 | 70 | N | N | N |

TABLE 1-continued

| | IF: (conditions:) | THEN: Steering Gain (%) | Accel. (%) | Decel. (%) | FNR Locked Out | Ctr-rot. Locked Out | Max Speed (MPH) |
|---|---|---|---|---|---|---|---|
| 49 | Ground Speed = 3–6 MPH AND Bucket Load = 0–600 lb AND Bucket Height = 2.5–5 ft | 100 | 75 | 75 | N | N | N |
| 50 | Ground Speed = 3–6 MPH AND Bucket Load = 0–600 lb AND Bucket Height > 5 ft | 90 | 50 | 70 | N | N | 3 |
| 51 | Ground Speed = 3–6 MPH AND Bucket Load = 600–1200 lb AND Bucket Height = 2.5–5 ft | 100 | 75 | 75 | Y | Y | N |
| 52 | Ground Speed = 3–6 MPH AND Bucket Load = 600–1200 lb AND Bucket Height > 5 ft | 90 | 50 | 70 | N | N | 3 |
| 53 | Ground Speed = 3–6 MPH AND Bucket Load > 1200 lb AND Bucket Height = 2.5–5 ft | 100 | 50 | 70 | N | N | 3 |
| 54 | Ground Speed = 3–6 MPH AND Bucket Load > 1200 lb AND Bucket Height > 5 ft | 90 | 50 | 70 | N | N | 3 |
| 55 | Ground Speed = 6–12 MPH AND Bucket Load = 0–600 lb AND Bucket Height = 0–2.5 ft | 75 | 85 | 85 | Y | Y | N |
| 56 | Ground Speed = 6–12 MPH AND Bucket Load = 600–1200 lb AND Bucket Height = 0–2.5 ft | 75 | 75 | 75 | Y | Y | N |
| 57 | Ground Speed = 6–12 MPH AND Bucket Load > 1200 lb AND Bucket Height = 0–2.5 ft | 75 | 50 | 70 | Y | Y | N |
| 58 | Ground Speed = 6–12 MPH AND Bucket Load = 0–600 lb AND Bucket Height = 2.5–5 ft | 75 | 50 | 70 | Y | Y | 6 |
| 59 | Ground Speed = 6–12 MPH AND Bucket Load = 70–600 lb AND Bucket Height > 5 ft | 75 | 50 | 70 | N | N | 3 |
| 60 | Ground Speed = 6–12 MPH AND Bucket Load = 600–1200 lb AND Bucket Height = 2.5–5 ft | 75 | 75 | 75 | Y | Y | 6 |
| 61 | Ground Speed = 6–12 MPH AND Bucket Load = 600–1200 lb AND Bucket Height > 5 ft | 75 | 50 | 70 | N | N | 3 |
| 62 | Ground Speed = 6–12 MPH AND Bucket Load > 1200 lb AND Bucket Height = 2.5–5 ft | 75 | 50 | 70 | Y | Y | 6 |
| 63 | Ground Speed = 6–12 MPH AND Bucket Load > 1200 lb AND Bucket Height > 5 ft | 75 | 50 | 70 | N | N | 3 |
| 64 | Ground Speed > 12 MPH AND Bucket Load = 0–600 lb AND Bucket Height = 0–2.5 ft | 50 | 75 | 75 | Y | Y | N |
| 65 | Ground Speed > 12 MPH AND Bucket Load = 600–1200 lb AND Bucket Height = 0–2.5 ft | 50 | 75 | 75 | Y | Y | N |
| 66 | Ground Speed > 12 MPH AND Bucket Load > 1200 lb AND Bucket Height = 0–2.5 ft | 50 | 50 | 70 | Y | Y | N |
| 67 | Ground Speed > 12 MPH AND Bucket Load = 0–600 lb AND Bucket Height = 2.5–5 ft | 50 | 75 | 75 | Y | Y | 6 |
| 68 | Ground Speed > 12 MPH AND Bucket Load = 0–600 lb AND Bucket Height > 5 ft | 50 | 50 | 70 | N | N | 3 |
| 69 | Ground Speed > 12 MPH AND Bucket Load = 600–1200 lb AND Bucket Height = 2.5–5 ft | 50 | 75 | 75 | Y | Y | 6 |
| 70 | Ground Speed > 12 MPH AND Bucket Load = 600–1200 lb AND Bucket Height > 5 ft | 50 | 50 | 70 | N | N | 3 |
| 71 | Ground Speed > 12 MPH AND Bucket Load > 1200 lb AND Bucket Height = 2.5–5 ft | 50 | 50 | 70 | Y | Y | 6 |
| 72 | Ground Speed > 12 MPH AND Bucket Load > 1200 lb AND Bucket Height > 5 ft | 50 | 50 | 70 | N | N | 3 |

Figure 4:
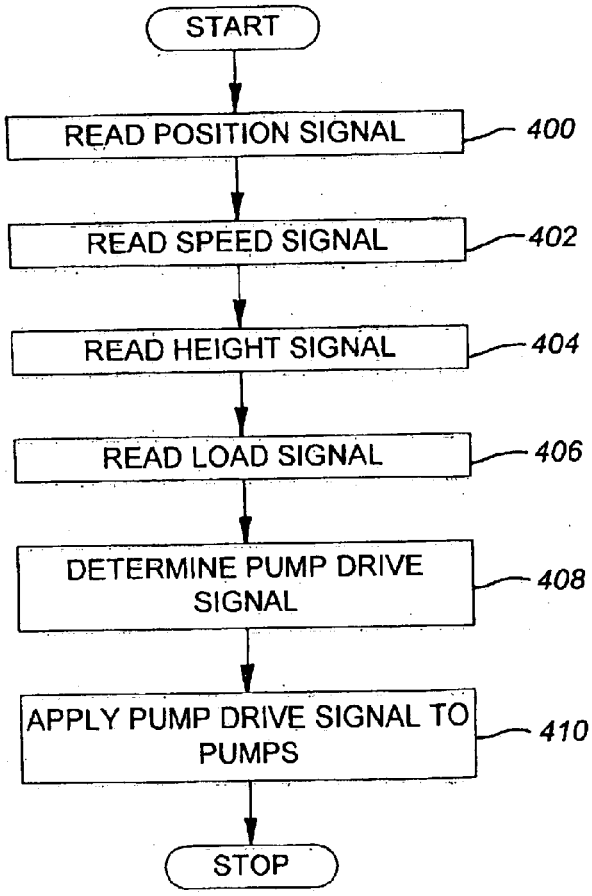
FIG. 4 is a flow chart illustrating the process of calculating the pump drive signal applied to the variable displacement hydraulic pumps that drive the motors.

FIG. 4 illustrates the process performed by electronic controller 302 when it responds to operator manipulation of the operator input device 308, calculates the pump drive signal and attenuates' or derates this signal in accordance with the rules of TABLE 1.

In block 400, controller 302 is programmed to read the position signal generated by operator input device 308 that indicates the position of the operator input device 308. Whether input device 308 is a joystick, multiple levers or some similar device, it generates a signal defining a commanded speed and direction and degree of turning of the vehicle. Controller 302 reads these signals and saves them for use in computations.

In block 402, controller 302 reads the speed signal indicative of the speed of the vehicle that is generated by speed sensor 310. Controller 302 saves this speed signal for use in later computations. In the event there are two or more speed sensors, controller 302 may read them and combine them to get a more accurate indication of vehicle speed.

In block 404, controller 302 reads the height signal generated by height sensor 306 that indicates the height of the vehicle load. Controller 302 saves the height signal for use in later computations.

In block 406, controller 302 reads the load signal generated by load sensor 304 that varies with the load applied by the implement (such as bucket 114) coupled to the loader arms. Controller 302 saves this signal for us in further computations.

In block 408, controller 302 determines the drive signal to apply to drive pumps 202 and 204 in response to the operator commands. If the particular vehicle operating conditions indicate the vehicle is going too fast, has too great a load, or has the load raised too high as indicated by the signals from the speed, height and load sensors (see TABLE 1), controller 302 derates or reduces the drive signals applied to the drive pumps to make the vehicle turn slower, accelerate slower and decelerate slower.

In block 410, controller 302 applies the drive signal to each of hydraulic pumps 202 and 204, which in turn drive the wheels 104.

In accordance with the present embodiment of the invention, we have disclosed a control system for a skid steer vehicle that reduces, attenuates or derates the vehicle's response to operator commands based upon vehicle operational conditions including vehicle speed, load height and load magnitude.

We claim:

1. A control system for the steering of a skid steer vehicle having a loader arm capable of carrying a load, the control system comprising:

(i) a means for sensing the amount of load and generating a signal indicative thereof;

(ii) a means for sensing the height of the load and generating a signal indicative thereof;

(iii) a means for sensing the speed of the vehicle and generating a signal indicative thereof;

(iv) a means responsive to operator manipulation for generating an operator vehicle motion command; and (v) an electronic controller coupled to the means of sections (i), (ii), (iii), and (iv), to generate a pump drive signal based at least upon the magnitude of signals received from the means of sections (i), (ii), (iii), and (iv).

2. The control system of claim 1, wherein the pump drive signal controls the displacement of at least one positive displacement hydraulic pump.

3. The control system of claim 2, wherein the pump drive signal controls the displacement of at least two positive displacement pumps.

4. The control system of claim 3, wherein the at least two positive displacement pumps include a first positive displacement pump that is fluidly coupled to at least a first hydraulic motor rotationally coupled to and disposed to drive at least one vehicle wheel on the left side of the vehicle and at least a second hydraulic motor rotationally coupled to and disposed to drive at least a second vehicle wheel disposed on the right side of the vehicle.

5. The control system of claim 4, wherein (1) the means for sensing the amount of load include a pressure sensor capable of measuring the pressure of a tire, the pressure of a loader cylinder, or the pressure of a suspension cylinder pressure, (2) the means for sensing the height of the loader arm include a loader cylinder position sensor or a loader arm position sensor, (3) the means-for sensing the vehicle speed include a wheel speed sensor, a hydrostatic motor speed sensor, a GPS receiver, a ground sensing laser, or a ground-sensing radar, and (4) the means responsive to operator manipulation include a joystick or a left-hand drive lever and right-hand drive lever.

6. The vehicle of claim 1 wherein the load sensor, includes a sensor disposed to detect the pressure in a loader arm lift cylinder.

7. A method of controlling the steering of a skid steer vehicle having a plurality of wheels mounted on the left vehicle side driven by at least a first hydraulic motor and a plurality of wheels on the right vehicle side driven by at least a second hydraulic motor, the vehicle further including at least a first hydraulic pump to drive the at least a first hydraulic motor and at least a second hydraulic pump to drive the at least a second hydraulic motor and an electronic controller coupled to the at least a first and at least a second hydraulic pumps to control their specific displacement, the method comprising the steps of:

(i) receiving a signal representative of a vehicle load;

(ii) receiving a signal representative of the height of at least a portion of the vehicle load;

(iii) receiving a signal representative of the speed of the vehicle;

(iv) receiving an operator-generated vehicle motion command; and (v) combining the signals of steps (i), (ii), and (iii), with the command of step (iv) to generate a drive signal.

8. The method of claim 7, wherein the vehicle further includes a chassis, at least one loader lift arm and an implement, the arm having a first end coupled to the chassis and a second end coupled to the implement, wherein at least a portion of the vehicle load includes a load carried by the implement, and further wherein the step of receiving a signal representative of a vehicle load includes the step of receiving a signal representative of the load carried by the implement.

9. The method of claim 8, further comprising the step of applying the drive signal to a positive displacement hydraulic pump to control the displacement thereof.

10. The method of claim 9, wherein the step of combining the signals includes the step of derating the vehicle's response to the operator-generated vehicle motion command.

11. The method of claim 10, wherein the step of derating the vehicle's response includes the step of derating the vehicle's turning rate.

12. The method of claim 10, wherein the step of derating the vehicle's response includes the step of derating the vehicle's rate of acceleration.

13. The method of claim 12, wherein the step of derating the vehicle's response includes the step of derating the vehicle's rate of deceleration.

14. The method of claim 13, wherein the step of receiving a signal representative of a vehicle load includes the step of receiving a signal from a loader lift arm cylinder pressure sensor.

15. The method of claim 14, wherein the step of receiving an operator-generated vehicle motion command includes the step of receiving a signal indicative of a commanded vehicle speed and commanded vehicle turning from an operator input device, and further wherein the operator input device includes a joystick.

16. The method of claim 15, wherein the step of receiving a signal representative of the vehicle includes the step of receiving a signal from one of the group consisting of a wheel speed sensor, a hydrostatic motor speed sensor, a GPS receiver, a ground sensing laser, and a ground-sensing radar.

* * * * *